US010315204B2

(12) United States Patent
Wang

(10) Patent No.: US 10,315,204 B2
(45) Date of Patent: Jun. 11, 2019

(54) NOZZLE ADJUSTMENT MEMBER FOR SPRINKLER

(71) Applicant: YUAN-MEI CORP., Changhua County (TW)

(72) Inventor: King-Yuan Wang, Changhua County (TW)

(73) Assignee: YUAN-MEI CORP., Changhua County (TW)

( * ) Notice: Subject to any disclaimer, the term of this patent is extended or adjusted under 35 U.S.C. 154(b) by 0 days.

(21) Appl. No.: 15/491,946

(22) Filed: Apr. 19, 2017

(65) Prior Publication Data

US 2017/0216853 A1 Aug. 3, 2017

Related U.S. Application Data

(62) Division of application No. 15/015,122, filed on Feb. 4, 2016, now Pat. No. 9,764,338, which is a division of application No. 12/662,295, filed on Apr. 9, 2010, now Pat. No. 9,289,783.

(51) Int. Cl.

| | |
|---|---|
| ***B05B 1/00*** | (2006.01) |
| ***B05B 1/16*** | (2006.01) |
| ***B05B 15/68*** | (2018.01) |
| ***B05B 15/652*** | (2018.01) |
| ***B05B 1/14*** | (2006.01) |
| ***B05B 1/28*** | (2006.01) |
| ***B05B 3/00*** | (2006.01) |
| ***B05B 3/02*** | (2006.01) |

(52) U.S. Cl.

CPC ..... *B05B 1/1627* (2013.01); *B05B 1/14* (2013.01); *B05B 1/28* (2013.01); *B05B 3/00* (2013.01); *B05B 3/02* (2013.01); *B05B 15/652* (2018.02); *B05B 15/68* (2018.02)

(58) Field of Classification Search

CPC ..... B05B 15/08; B05B 15/066; B05B 15/04; B05B 1/14

USPC ..... 239/225.1, 240, 227, 242, 246, 247, 239/DIG. 1, DIG. 2

See application file for complete search history.

(56) References Cited

U.S. PATENT DOCUMENTS 2,943,796 A * 7/1960 Smith ..... B05B 3/044 239/237
3,212,719 A * 10/1965 Di Corpo ..... A62C 2/08 239/541
D221,336 S * 8/1971 Raffler et al. ..... D23/216
(Continued)

*Primary Examiner* — Viet Le
(74) *Attorney, Agent, or Firm* — Raymond Y. Chan; David and Raymond Patent Firm

(57) ABSTRACT

A nozzle adjustment member for a sprinkler is revealed. A plurality of nozzle tubes aligned in at least one row is positioned on a wall of a hollow pipe. A top end of the nozzle tube is projecting to an outside of the hollow pipe. At least one pivot support is disposed on the outside of the hollow pipe. Each pivot support is pivoted with an adjustment piece having a plurality of guiding openings. The guiding openings are positioned over the plurality of nozzle tubes correspondingly. A nozzle cover is connected with the outside of the hollow pipe for covering the adjustment piece. A plurality of long through holes for mounting the corresponding nozzle tubes is arranged at the nozzle cover. Around a pivot hole, the adjustment piece swings so as to drive the plurality of nozzle tubes moving at an angle and different water distribution patterns are provided.

4 Claims, 17 Drawing Sheets

(56) References Cited

U.S. PATENT DOCUMENTS 3,647,140 A * 3/1972 Perrot ..... B05B 3/044 239/242
3,767,118 A * 10/1973 Oberto ..... B05B 3/044 137/834
3,907,204 A * 9/1975 Przystawik ..... B05B 3/16 239/19
4,245,786 A * 1/1981 Abrahamsen ..... B05B 3/044 239/242
D282,769 S * 2/1986 Lemkin ..... D23/216
4,632,313 A * 12/1986 Rinkewich ..... B05B 1/1654 137/624.14
5,042,719 A * 8/1991 Magris ..... B05B 3/044 239/242
5,305,956 A * 4/1994 Wang ..... B05B 1/1645 239/242
5,511,727 A * 4/1996 Heren ..... B05B 3/044 239/242
5,628,458 A * 5/1997 Kuo ..... B05B 1/20 239/242
5,730,366 A * 3/1998 DeWitt ..... B05B 1/20 239/242
5,845,850 A * 12/1998 Guo ..... B05B 3/044 239/242
6,062,490 A * 5/2000 Katzer ..... B05B 1/30 239/246
6,135,356 A * 10/2000 Mitzlaff ..... B05B 15/652 239/1
6,334,577 B1 * 1/2002 Chih ..... A62C 31/02 239/242
6,568,603 B2 * 5/2003 Chao ..... B05B 1/1627 239/242
6,676,041 B1 * 1/2004 McLoughlin ..... B05B 1/20 239/450
6,736,340 B1 * 5/2004 Wang ..... A62C 2/08 239/242
7,252,246 B2 * 8/2007 Heren ..... B05B 1/1654 239/242
7,258,286 B1 * 8/2007 Wang ..... A62C 2/08 239/240
7,284,714 B1 * 10/2007 Wang ..... B05B 1/1663 239/240
7,607,590 B2 * 10/2009 Nies ..... B05B 15/652 239/255
D620,552 S * 7/2010 Mayher ..... D23/221
7,909,266 B2 * 3/2011 Lo ..... B05B 3/044 239/240
8,998,108 B2 * 4/2015 Hsieh ..... B05B 15/063 239/242
2007/0235568 A1 * 10/2007 Wang ..... B05B 1/1663 239/562
2008/0054103 A1 * 3/2008 Nies ..... B05B 15/652 239/562
2009/0308950 A1 * 12/2009 Lo ..... B05B 3/044 239/242

* cited by examiner

NOZZLE ADJUSTMENT MEMBER FOR SPRINKLER

CROSS REFERENCE OF RELATED APPLICATION

This is a Divisional Application that claims priority to U.S. non-provisional application, application Ser. No. 15/015,122, filed Feb. 4, 2016, which is a Divisional Application that claims priority to U.S. non-provisional application, application Ser. No. 12/662,295, filed Apr. 9, 2010, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a sprinkler, and more particularly to a nozzle adjustment member for a sprinkler that adjusts water distribution patterns into a plurality of parallel water jets or a plurality of water jets with different angles therebetween by increasing of the angle between two adjacent water flows gradually.

Description of Related Arts

Referring to prior arts such as EP 0970752 A2, U.S. Pat. No. 6,135,356, DE 19830861, and US 20080054103 A1, the adjustment apparatus in these patents adjusts nozzles mounted therein synchronously by a parallel displacement of the nozzle or displacement on two-sides in different directions. Thus the nozzles move at an angle synchronously so as to provide sprinkling patterns with different angles. However, the adjustment apparatus is not located by a fixed pivot and the operation is not smooth.

Thus there is a need to improve the nozzle adjustment apparatus for sprinklers available now so as to provide a novel design of the nozzle adjustment apparatus for sprinklers.

SUMMARY OF THE PRESENT INVENTION

The invention is advantageous in that it provides a nozzle adjustment member for a sprinkler that includes at least one pivot support arranged on outside of a hollow pipe and the pivot support is pivoted with an adjustment piece having a plurality of guiding openings. Each guiding opening is positioned over a corresponding nozzle tube projecting from the hollow pipe. Thereby the adjustment piece swings around the pivot support (as a pivot) so as to drive the plurality of nozzles moving and tilting at different angles for providing various sprinkling patterns.

Additional advantages and features of the invention will become apparent from the description which follows, and may be realized by means of the instrumentalities and combinations particular point out in the appended claims.

In order to achieve the above object, a nozzle adjustment member for a sprinkler according to the present invention mainly includes a hollow pipe, at least one adjustment piece and a nozzle cover.

The hollow pipe is connected with a pivot disposed on a top of a seat of a sprinkler. A flat top stage with a plurality of holes is arranged on top of the hollow pipe. The plurality of holes is arranged into at least one row and each hole is positioned over a corresponding nozzle tube. A top end of each nozzle tube projects from the hole and a bottom of each nozzle tube is connected in series by at least one belt. Moreover, at least one pivot support is arranged at outside of the flat top stage and is pivoted with the adjustment piece for swinging and movement of the adjustment piece.

The adjustment piece includes a pivot hole pivoted with the above pivot support arranged at one end thereof, a plurality of guiding openings spaced at an interval on the other end thereof and at least one control part on the end opposite to the end with the pivot hole. The plurality of guiding openings is positioned over the plurality of nozzle tubes. The control part is for convenience of holding and moving the adjustment piece and is integrated with the adjustment piece.

The nozzle cover is fastened and connected with an outside of the hollow pipe for covering the adjustment piece. A plurality of long through holes for being assembled with corresponding nozzle tubes is disposed on top of the nozzle cover.

In accordance with the structure form by above components, the pivot hole and the pivot support pivoted with each other is used as a rotation pivot and the adjustment piece can swing and move for synchronously driving the nozzle tube positioned inside each guiding opening to move at different angles. Due to the change of the angle of the nozzle tube driven by the corresponding guiding opening of the adjustment piece, the water distribution pattern changes into a plurality of parallel water jets or a plurality of water jets with increasing angles therebetween and more sprinkling patterns are provided.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
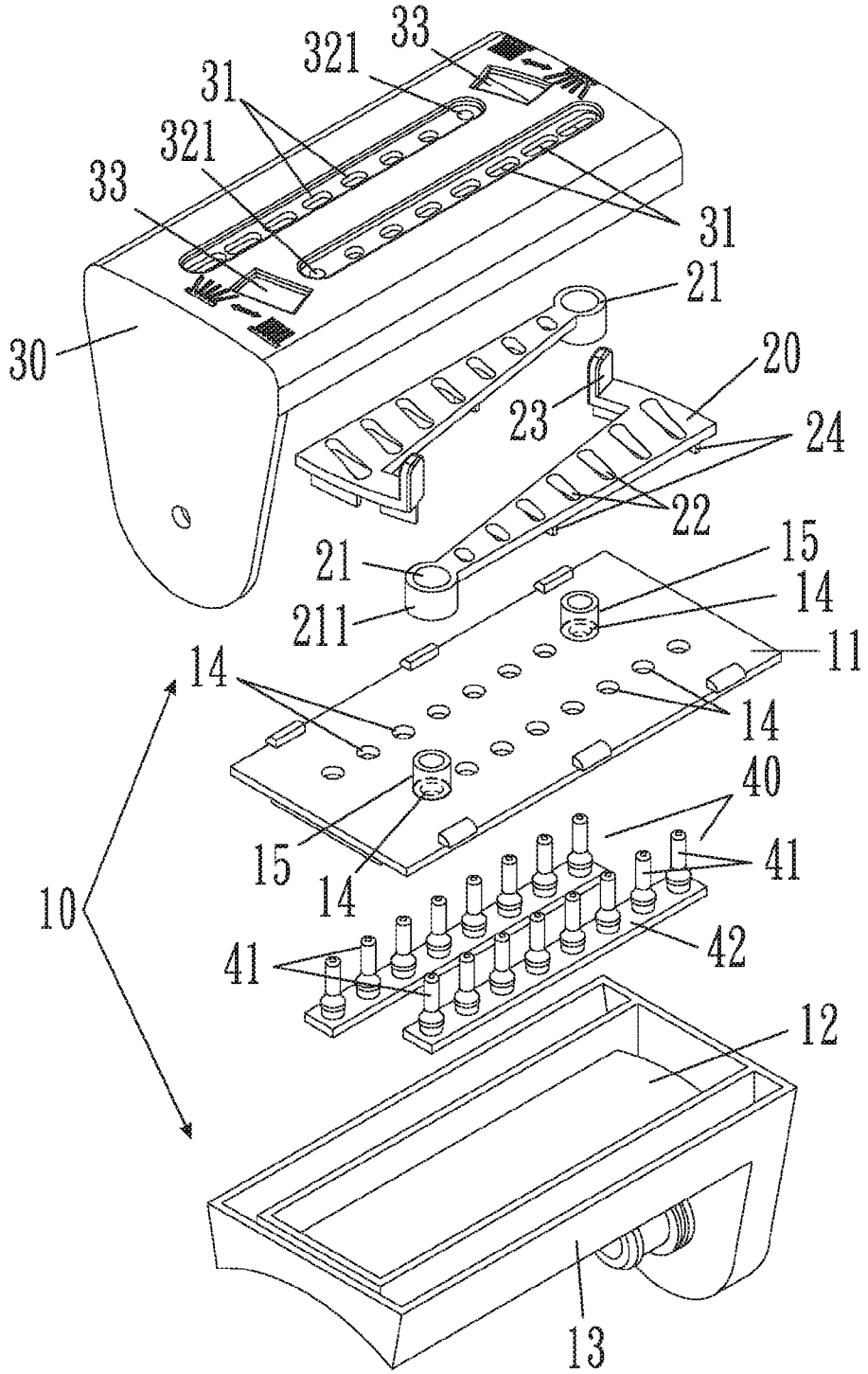
FIG. 1 is an explosive view of a nozzle adjustment member for a sprinkler according to an embodiment of the present invention.
Figure 2:
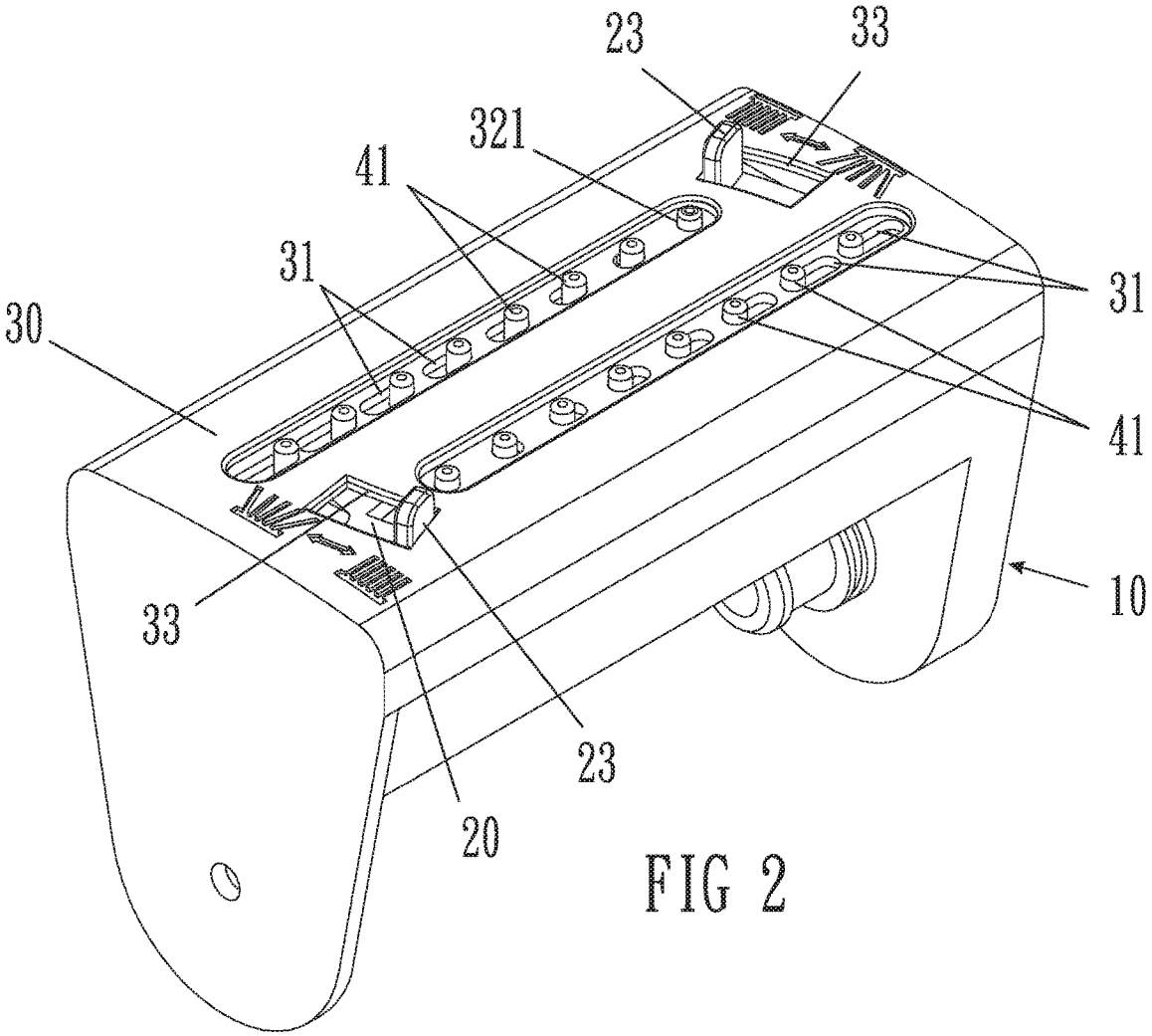
FIG. 2 is a perspective view of a nozzle adjustment member for a sprinkler according to an embodiment of the present invention.
Figure 3:
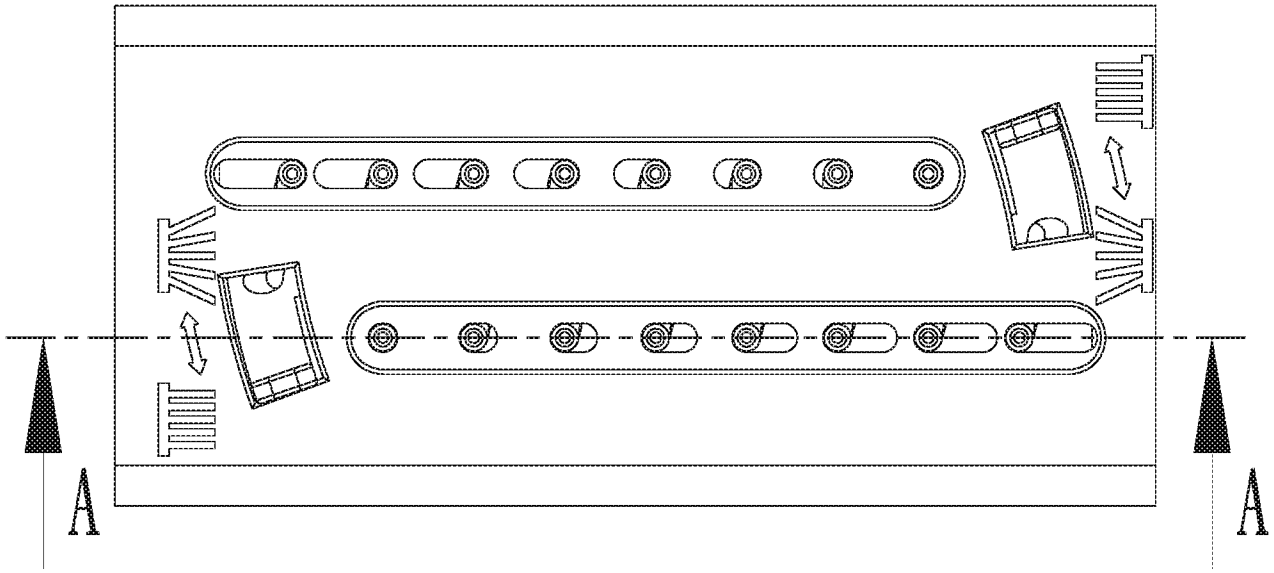
FIG. 3 is a top view of a nozzle adjustment member for a sprinkler according to an embodiment of the present invention.
Figure 4:
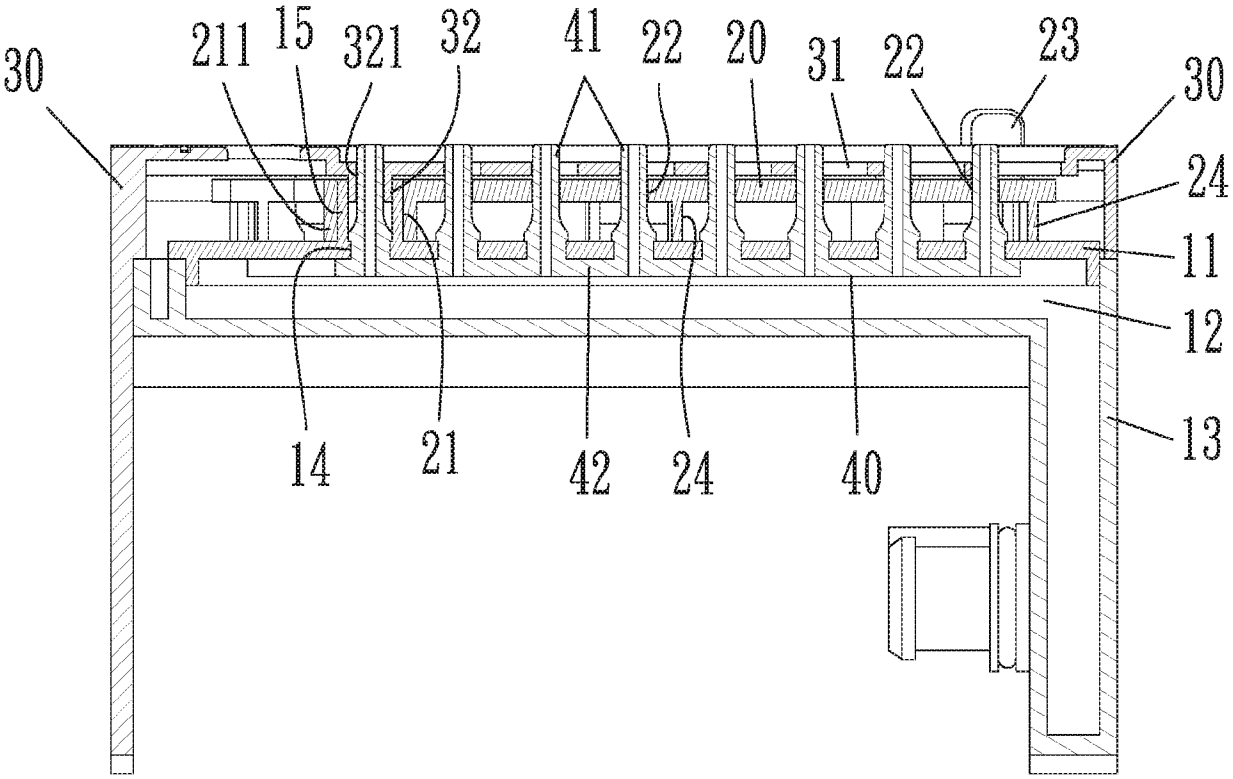
FIG. 4 is a cross sectional view along the A-A line of the embodiment in FIG. 3.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 4 of the drawings, a nozzle adjustment member for a sprinkler according to a first embodiment is illustrated, wherein the nozzle adjustment member for a sprinkler comprises a hollow pipe 10, two adjustment pieces 20, a nozzle cover 30 and two nozzle sets 40.

The hollow pipe 10 comprises a flat top stage 11 and a base 13 having a receiving slot 12 with an opening formed upwardly. A plurality of holes 14 spaced at an interval is disposed on a top wall of the hollow pipe 10. The holes 14 are arranged in at least one row. The holes 14 are arranged into two rows in the embodiment of the present invention. Two pivot supports 15 with the same height extending upwardly are arranged at two diagonal corners of the two rows of holes 14. The holes 14 are positioned over and assembled with a plurality of nozzle tubes 41 of the two nozzle sets 40 inside the hollow pipe 10. The holes 14 inside the pivot supports 15 are assembled with corresponding the nozzle tubes 41 of the nozzle sets 40 while each of the pivot support 15 is received in a pivot hole 21 at one end of the adjustment piece 20.

Each of the two nozzle sets 40 comprises a plurality of nozzle tubes 41 and a belt 42 connecting to the bottom of the plurality of nozzle tubes 41. And the plurality of nozzle tubes 41 of each nozzle set 40 is assembled with and located in two rows of holes 14 on the hollow pipe 10. Moreover, the belt 42 of each nozzle set 40 can be integrated into one piece.

Each of the two adjustment pieces 20 includes a pivot hole 21 disposed on one end and a plurality of guiding openings 22, extending outwardly from the pivot hole 21 to the outer end thereof. A pivot bushing 211 extending downwardly is disposed on the bottom of one end of the adjustment piece 20, around the pivot hole 21. The pivot bushing 211 is for being pivoted in or covered around the pivot support 15 of the hollow pipe 10. Moreover, at least one pin 24 is set on the bottom of the other end of the adjustment piece 20. The pivot bushing 211 and the pin 24 are at the same height and their bottoms are leaning against the flat top stage 11 of the hollow pipe 10. Furthermore, a sheet-like control part 23 is arranged on one end of the adjustment piece 20 and is opposite to the end of the pivot hole 21.

The nozzle cover 30 is a cover with a downward opening for connecting with and covering the hollow pipe 10. A plurality of long through holes 31 is disposed on top of the nozzle cover 30 and is arranged into two rows. Each row of the long through holes 31 is integrated to form a slot (not shown in figure). Each row of the long through holes 31 is positioned over the plurality of nozzle tubes 41 of one nozzle set 40 correspondingly. At least one shaft tube 32 is arranged at one end of each row of the plurality of through holes 31 so as to insert into the pivot support 15 of the hollow pipe 10 or the pivot hole 21 of the adjustment piece 20. Moreover, a receiving space 33 is disposed on each of two diagonal corners of the two rows of the long through holes 31. The receiving space 33 is not only for receiving the control part 23, but also providing a certain space for displacement of the control part 23. Each row of long through holes 31 can also be divided into a plurality of long grooves. It is worth mentioning that the shaft tube 32 is mounted inside the pivot support 15 and has a preset shaft hole 321 which is positioned over the corresponding nozzle tube 41 according to the embodiment of the present invention.

Thereby, the nozzle adjustment member for a sprinkler according to the present invention includes at least two rows of nozzle tubes 41 for adjusting parallel water jets. The two adjustment pieces 20 swing respectively around the pivot hole 21 which is used as a static pivot so as to move the plurality of nozzle tubes 41 at different angle synchronously.

In addition, the nozzle tube 41 mounted in the corresponding hole 14 of the pivot support 15 of the hollow pipe 10 can be removed and this has no effect on the movement and displacement of the adjustment piece 20.

Figure 5:
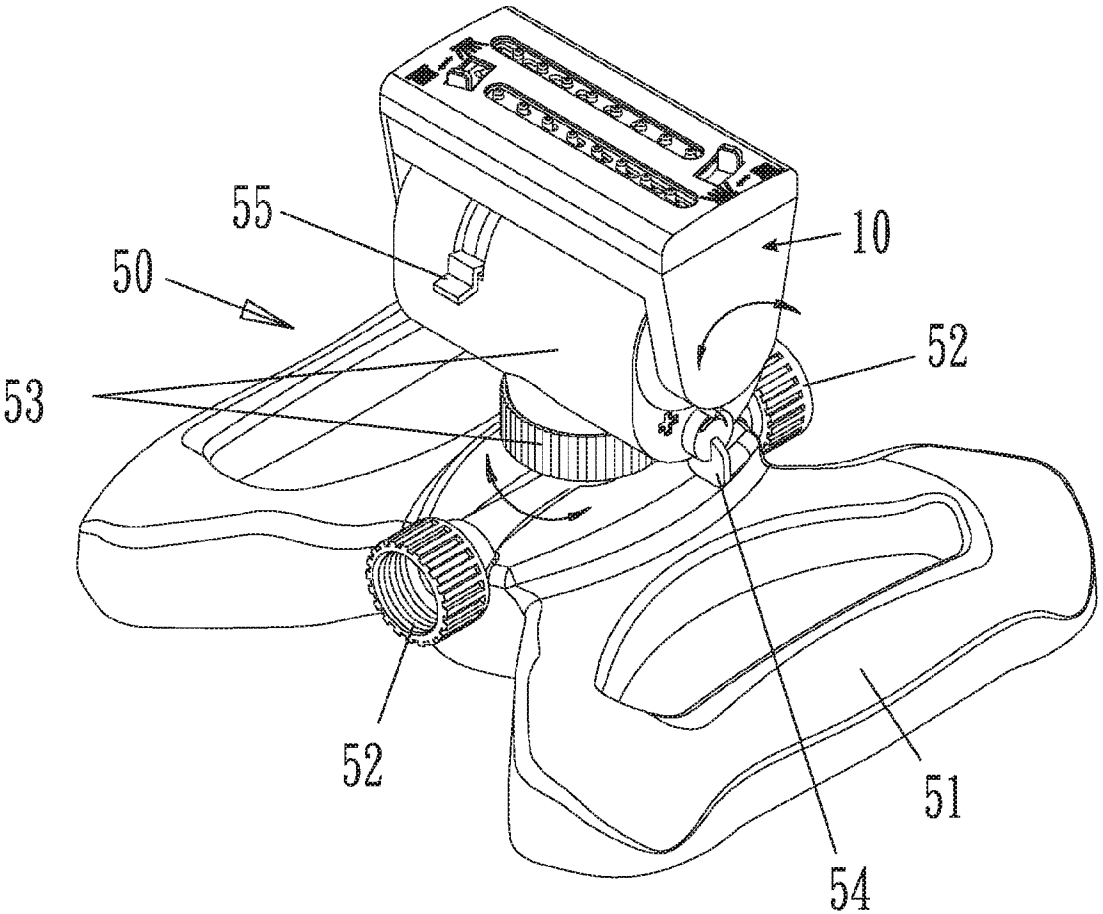
FIG. 5 is a schematic drawing showing an embodiment of the present invention connected with a sprinkler.
Figure 6:
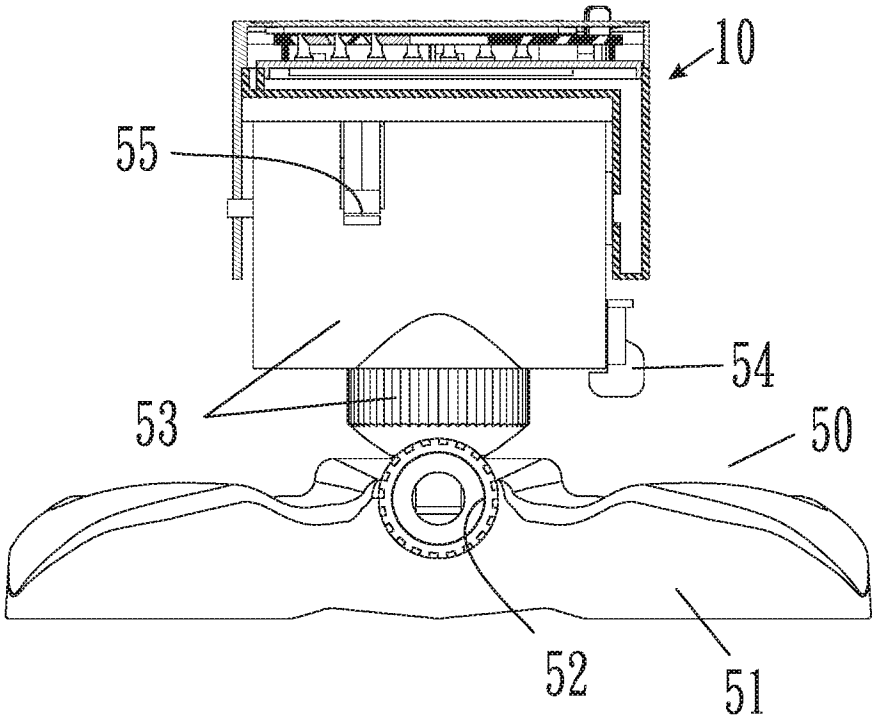
FIG. 6 is a front view of the embodiment connected with the sprinkler in FIG. 5.
Figure 7:
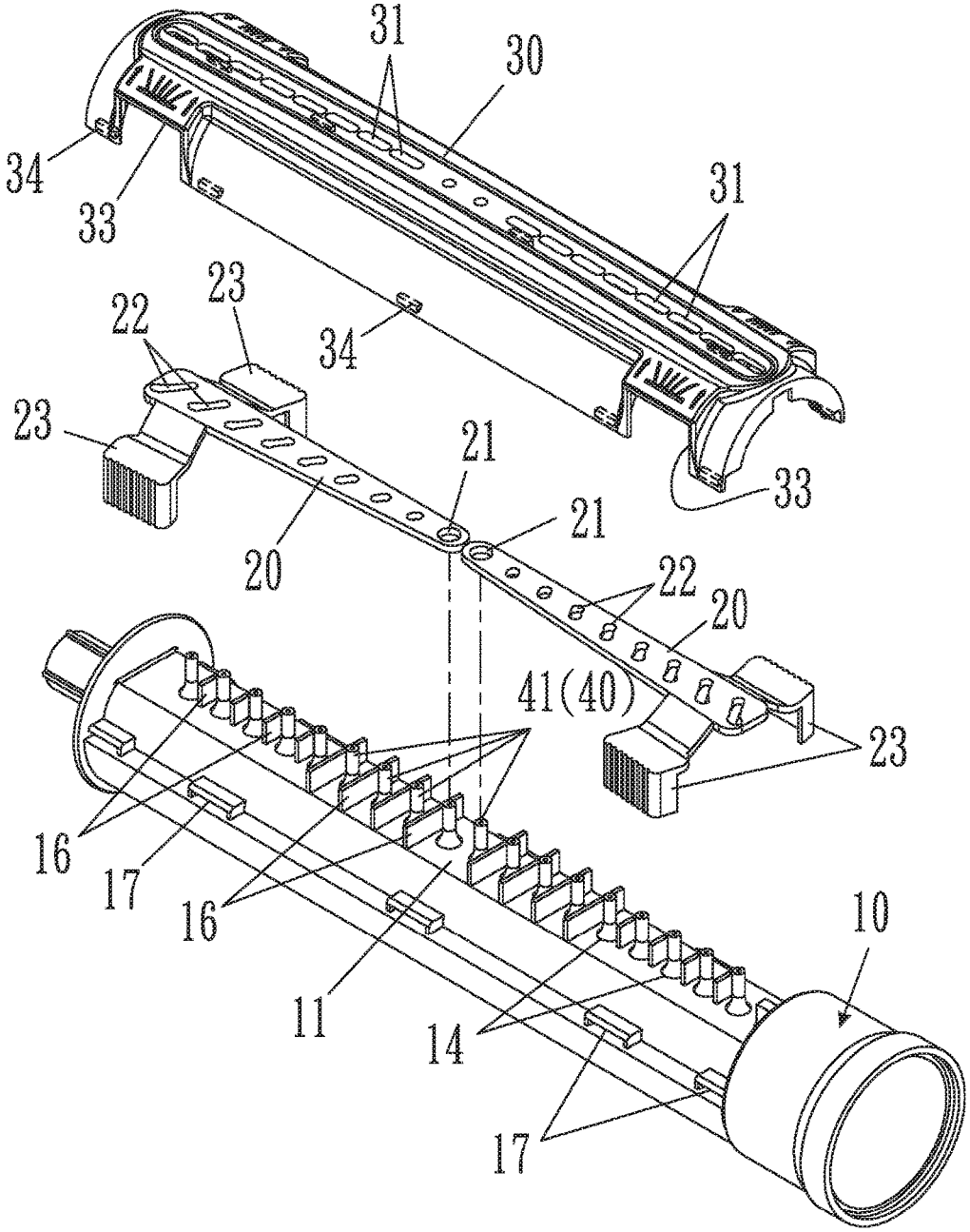
FIG. 7 is an explosive view of a nozzle adjustment member for a sprinkler according to a preferred embodiment of the present invention.

As shown in the FIG. 5 and FIG. 6, the nozzle adjustment member of the present invention connected with a sprinkler in use is illustrated. The sprinkler 50 according to the embodiment of the present invention includes a seat 51 and at least one water inlet 52 arranged at least one side of the seat 51 for connected with a water source, a pivot 53 which rotates 360 degrees clockwise or counterclockwise, and a fine adjustment knob 54 for control of outlet water flow extending outwardly from the pivot 53. The two sides of the pivot 53 are connected with the hollow pipe 10 of the nozzle adjustment member of the present invention. Moreover, a control button 55 for adjustment angle of the forward and backward movement of the hollow pipe 10 is disposed on a preset position of the pivot 53. Thus the sprinkler is formed completely.

Referring from FIG. 7 to FIG. 15, another embodiment of a nozzle adjustment member for a sprinkler with the same effects is revealed. The nozzle adjustment member for a sprinkler includes a hollow pipe 10, two adjustment pieces 20 and a nozzle cover 30.

A flat top stage 11 with a plurality of holes 14 spaced at the same interval along an axis of the hollow pipe 10 is disposed on the top of the hollow pipe 10. The holes 14 are assembled with a nozzle set 40 mounted in the hollow pipe 10. A plurality of racks 16 equal in height is respectively arranged at the outside of the hollow pipe 10 and between the two adjacent holes 14. The nozzle set 40 is formed by a plurality of nozzle tubes 41 arranged in parallel with a certain interval. Moreover, the bottom surfaces of the nozzle tubes 41 are connected with one another by a belt 42 to form a bar-like structure. Each nozzle tube 41 is inserted through the corresponding hole 14 of the hollow pipe 10 correspondingly. The bottom of each of the plurality of nozzle tubes 41 is fixed and located in the corresponding hole 14 firmly while the top end of the nozzle tube 41 projects to outside of the hole 14. The height of the top end of the nozzle tube 41 out of the hole 14 is larger than the height of the rack 16. A plurality sets of symmetrical fastening holes 17 is disposed along two long sides of the flat top stage 11 of the hollow pipe 10 so as to be fastened and assembled with the nozzle cover 30.

The adjustment piece 20 is a flat plat. The bottom of the adjustment piece 20 is leaning against the top end of the plurality of racks 16 of the hollow pipe 10. A round pivot hole 21 is disposed on one end of the adjustment piece 20, near the edge of that end and a plurality of guiding openings 22 spaced at an interval is arranged on the adjustment piece 20 between the round pivot hole 21 and the other end of the adjustment piece 20. The pivot holes 21 and the plurality of guiding openings 22 of the two adjustment pieces 20 are positioned over the plurality of nozzle tubes 41 of the nozzle set 40 correspondingly. A projecting control part 23 is arranged on the edge of the front end as well as the rear end of the adjustment piece 20, near the outermost guiding opening 22 for convenience of holding and moving the adjustment piece 20.

Figure 8:
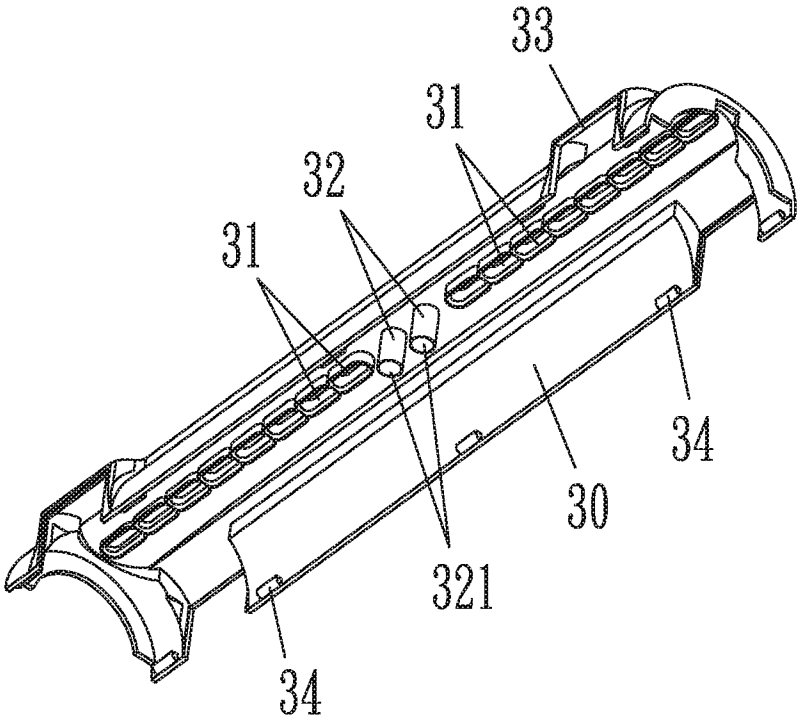
FIG. 8 is a bottom view of a nozzle cover according to the above preferred embodiment of the present invention.
Figure 9:
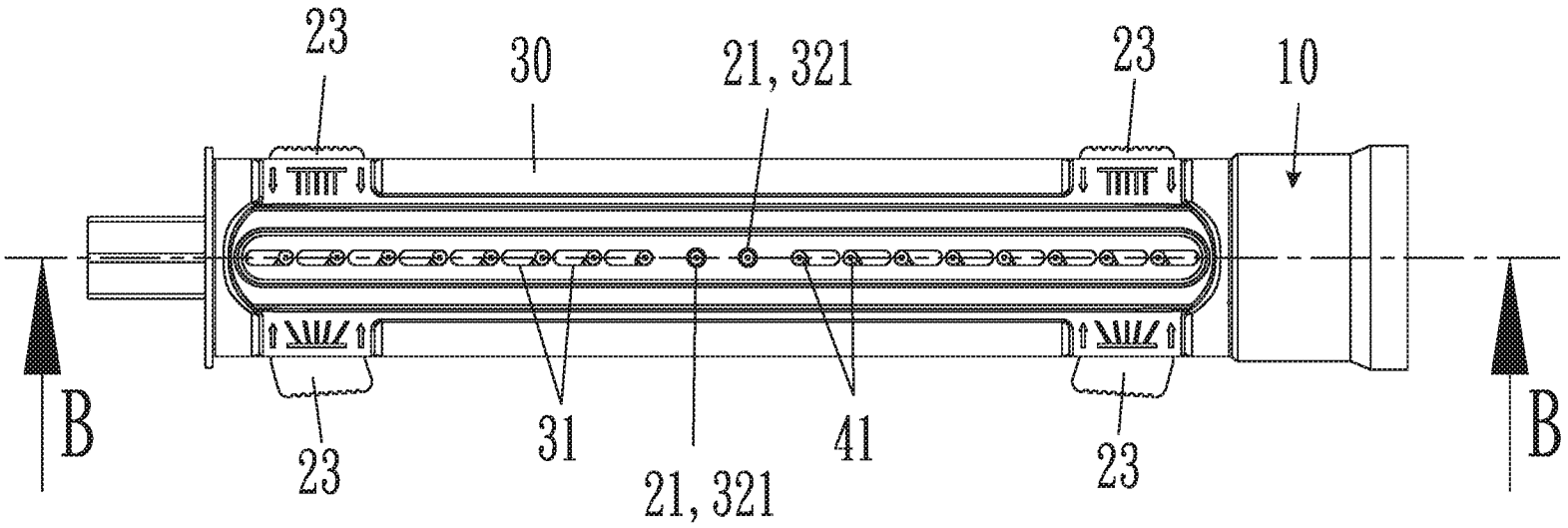
FIG. 9 is a top view of a nozzle adjustment member for a sprinkler according to the above preferred embodiment of the present invention.
Figure 10:
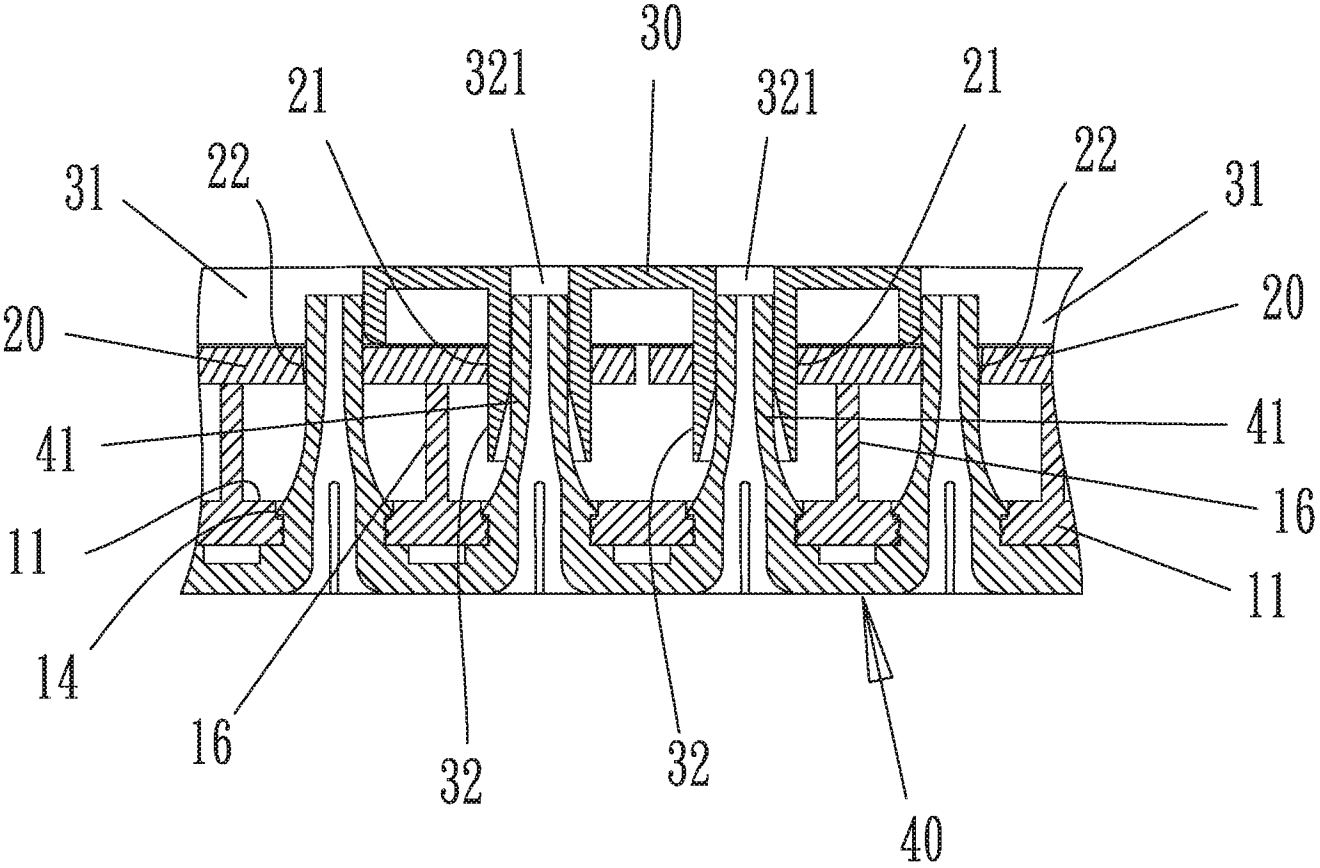
FIG. 10 is a cross sectional view along the B-B line of the above preferred embodiment in FIG. 9.
Figure 11:
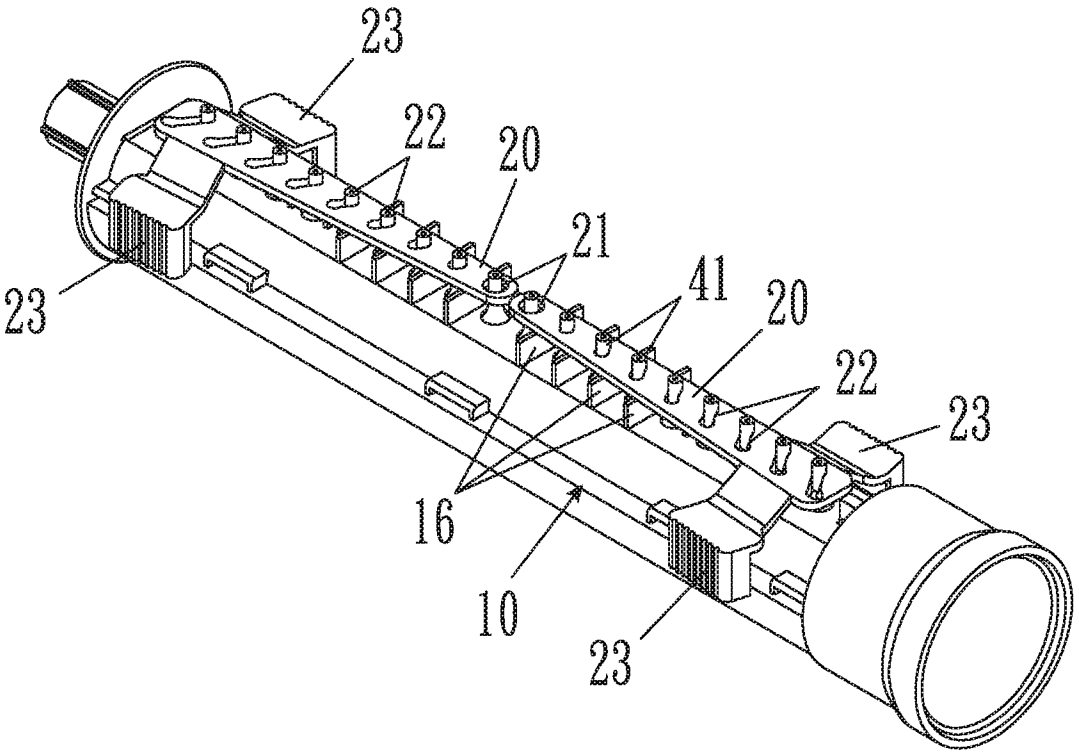
FIG. 11 is an assembly view showing an adjustment piece with a hidden nozzle cover according to the above preferred embodiment in FIG. 9 of the present invention.
Figure 12:
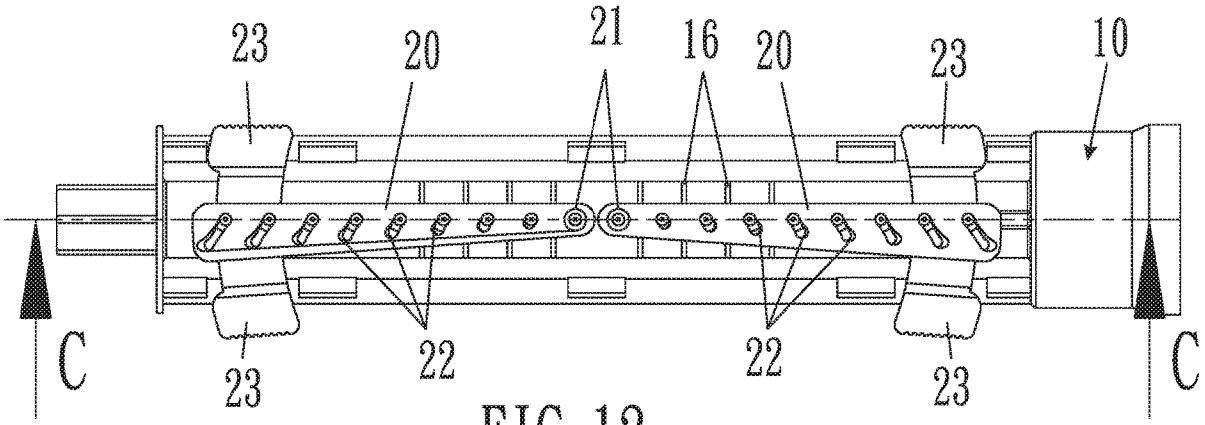
FIG. 12 is a top view of the above preferred embodiment in FIG. 11.
Figure 13:
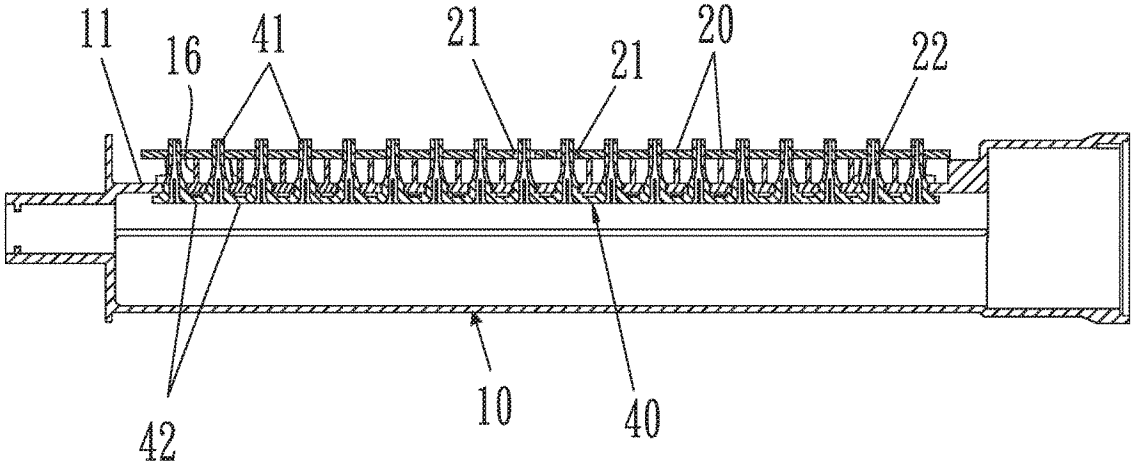
FIG. 13 is cross sectional view along the C-C line of the above preferred embodiment in FIG. 12.
Figure 14:
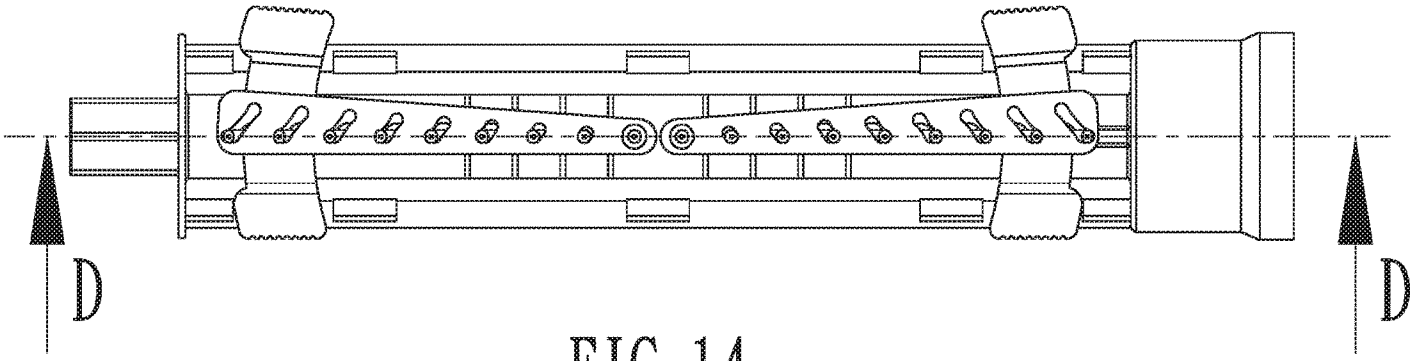
FIG. 14 is a top view of swinging adjustment pieces according to the above preferred embodiment of the present invention.
Figure 15:
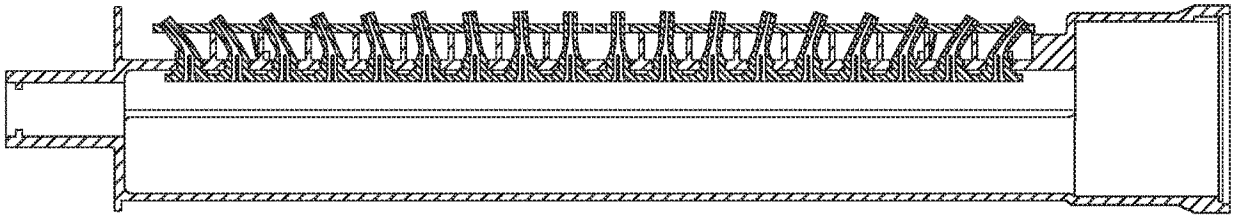
FIG. 15 is a cross sectional view along the D-D line of the above preferred embodiment in FIG. 14.

Referring to FIG. 8, the nozzle cover 30 is a cover with a downward opening. Two shaft tubes 32 extending downwardly are disposed on a middle part thereof and shaft holes 321 of these two shaft tubes 32 penetrate the cover. Moreover, the nozzle cover 30 includes a plurality of long through holes 31 extending outwards from the two shaft tubes 32 to two ends of the nozzle cover 30. The two shaft holes 321 and the plurality of long through holes 31 are aligned and are positioned over the plurality of nozzle tubes 41 of the nozzle set 40 correspondingly. The two shaft tubes 32 are respectively inserted through and located by the pivot holes 21 of the two adjustment pieces 20 while the shaft holes 321 are positioned over corresponding nozzle tubes 41. Furthermore, a plurality sets of symmetrical fastening blocks 34 is disposed along an inner side of the two long sides on the bottom of the inner surface of the nozzle cover 30 so as to be assembled with the plurality sets of symmetrical fastening holes 17 of the hollow pipe 10 correspondingly. Two receiving spaces 33 with a downward opening for receiving the control part 23 of the adjustment piece 20 are arranged at two outer ends of the two long sides of the nozzle cover 30 respectively.

In accordance with the structure constructed by above components, after the two adjustment pieces 20 and the nozzle cover 30 being arranged and located over the top of the hollow pipe 10 in turn, each nozzle tube 41 of nozzle set 40 is inserted through the pivot holes 21 and the guiding hole 22 of the two adjustment pieces 20 as well as the shaft holes 321 and the long through holes 31 of the nozzle cover 30 respectively and correspondingly. The top end of each nozzle tube 41 is projecting out of or close to the top surface of each long through hole 31 with a certain distance therebetween. As to the control part 23 near the outer end of the two adjustment pieces 20, the control part 23 is mounted in the receiving space 33 on the corresponding end of the nozzle cover 30.

Thereby the nozzle cover 30 and the hollow pipe 10 are integrated in one piece. While adjusting and moving the adjustment pieces 20, the nozzle cover 30 remains static. From a fixed pivot point formed by the connected pivot hole 21 and the shaft tube 32 on one end of the adjustment piece 20, the two adjustment pieces 20 respectively swing through the movement of the control parts 23 on the opposite end ends. Thus while moving the control part 23, the nozzle cover 30 is static and the nozzle tube 41 positioned in the shaft hole 321 of the shaft tube 32 is also static while other nozzle tubes 41 in the corresponding plurality of guiding opening 22 of the two adjustment pieces 20 are driven to be moved at an angle synchronously so as to generate radial water distribution patterns with different angles.

Moreover, the two adjustment pieces 20 are able to move to and fro in a swing independently. Thus once the nozzle set 40 is divided into two halves, approximately equal in area, or a plurality of independent parts to be driven and adjusted, more sprinkling patterns can be provided.

Figure 16:
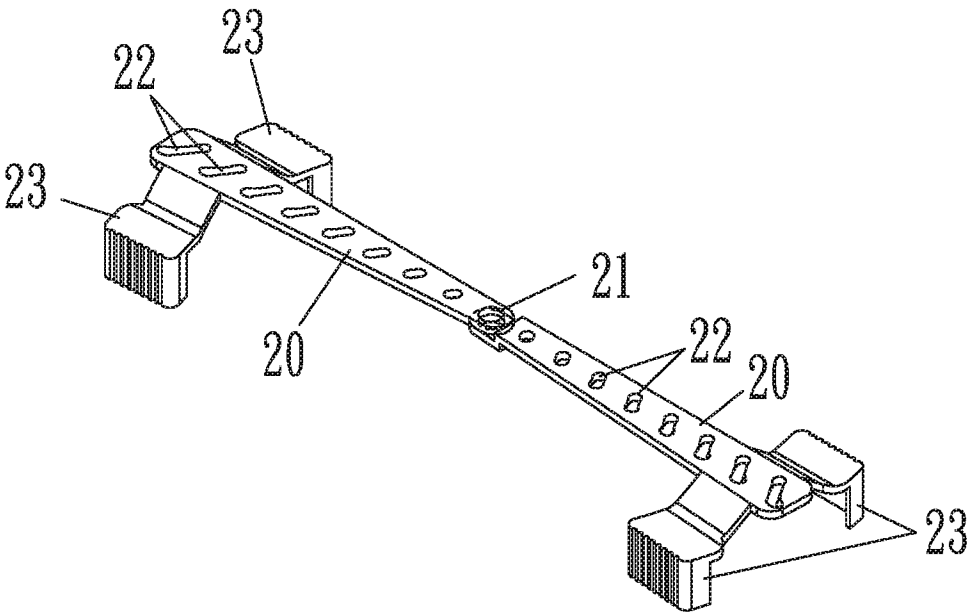
FIG. 16 is a schematic drawing showing an adjustment piece according to an embodiment of present invention.
Figure 17:
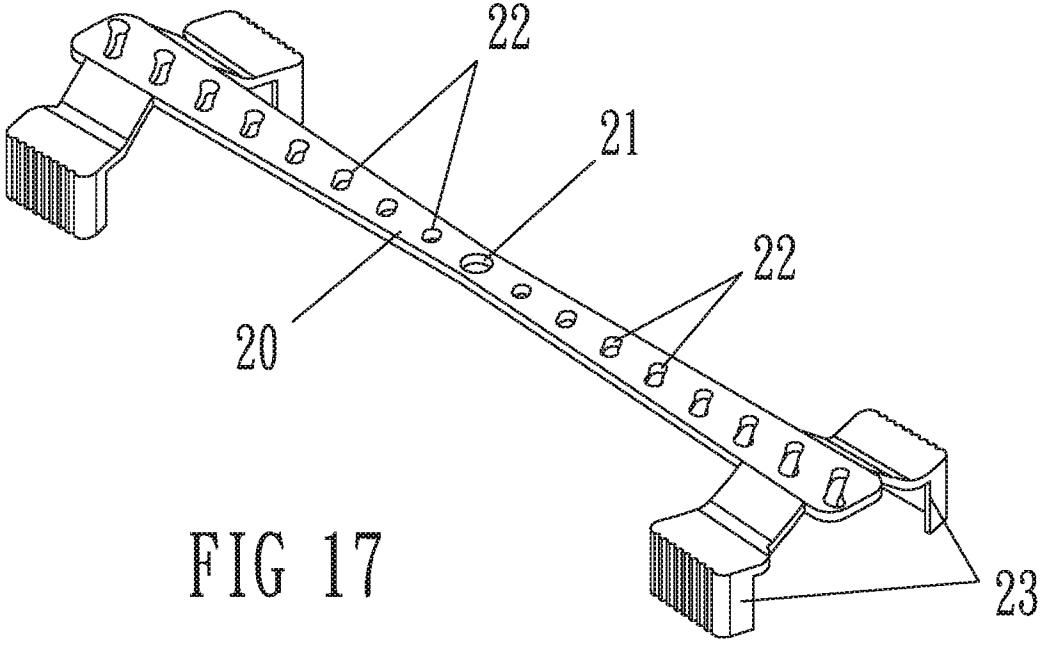
FIG. 17 is a schematic drawing showing an adjustment piece according to another embodiment of present invention.

As shown in FIG. 16, the pivot holes 21 of the two adjustment pieces 20 in the above embodiment are overlapped and integrated so as to swing around the same pivot point. Or as shown in FIG. 17, the two adjustment pieces 20 in the above embodiment are integrated into a single piece and the pivot hole 21 is arranged at the middle of the single adjustment piece 20. A plurality of guiding opening 22 spaced at an interval is arranged at the adjustment piece 20, extending from two sides of the pivot hole 21 to two ends of the adjustment piece 20.

Figure 18:
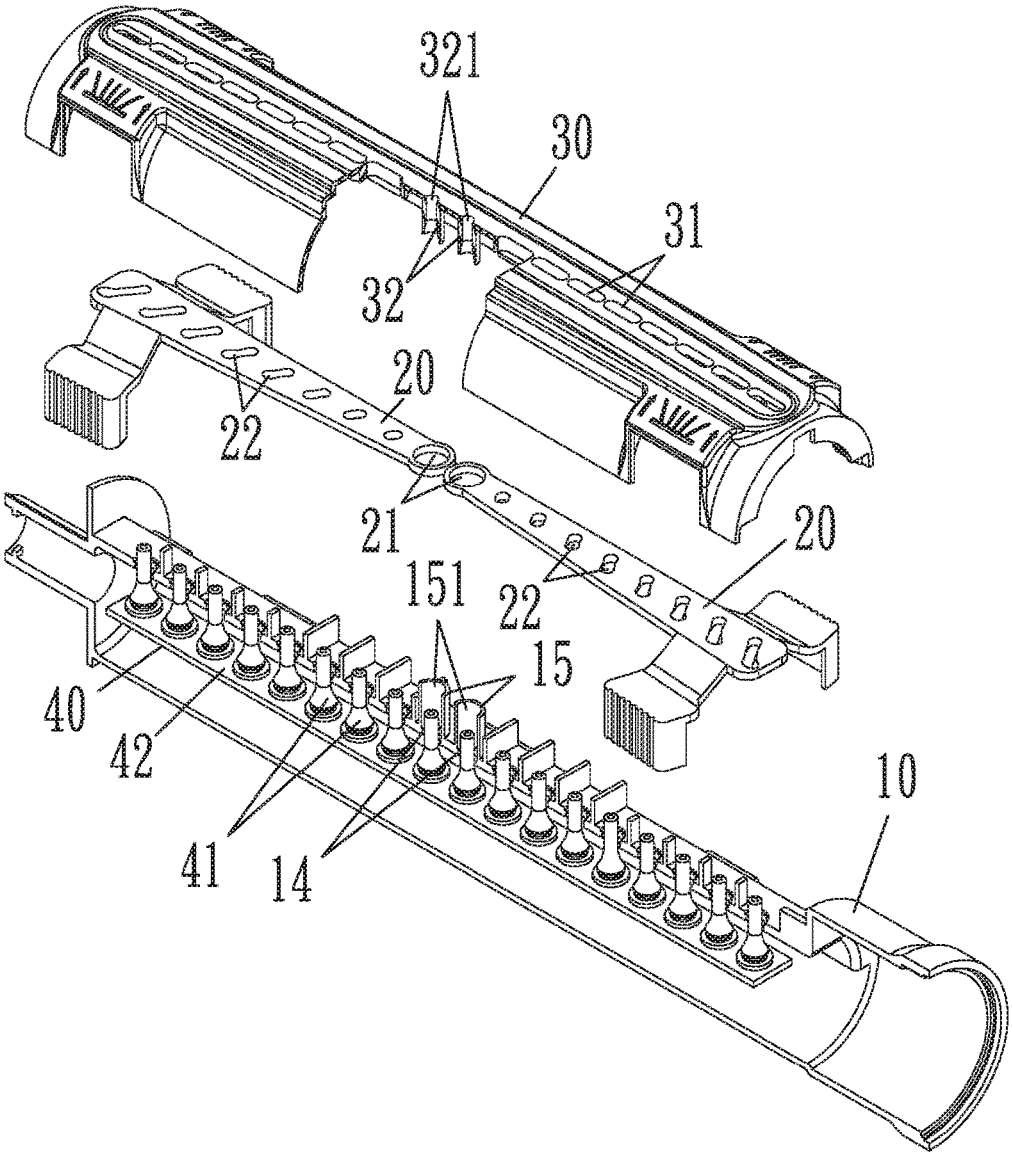
FIG. 18 is an explosive view of a further embodiment according to the present invention.
Figure 19:
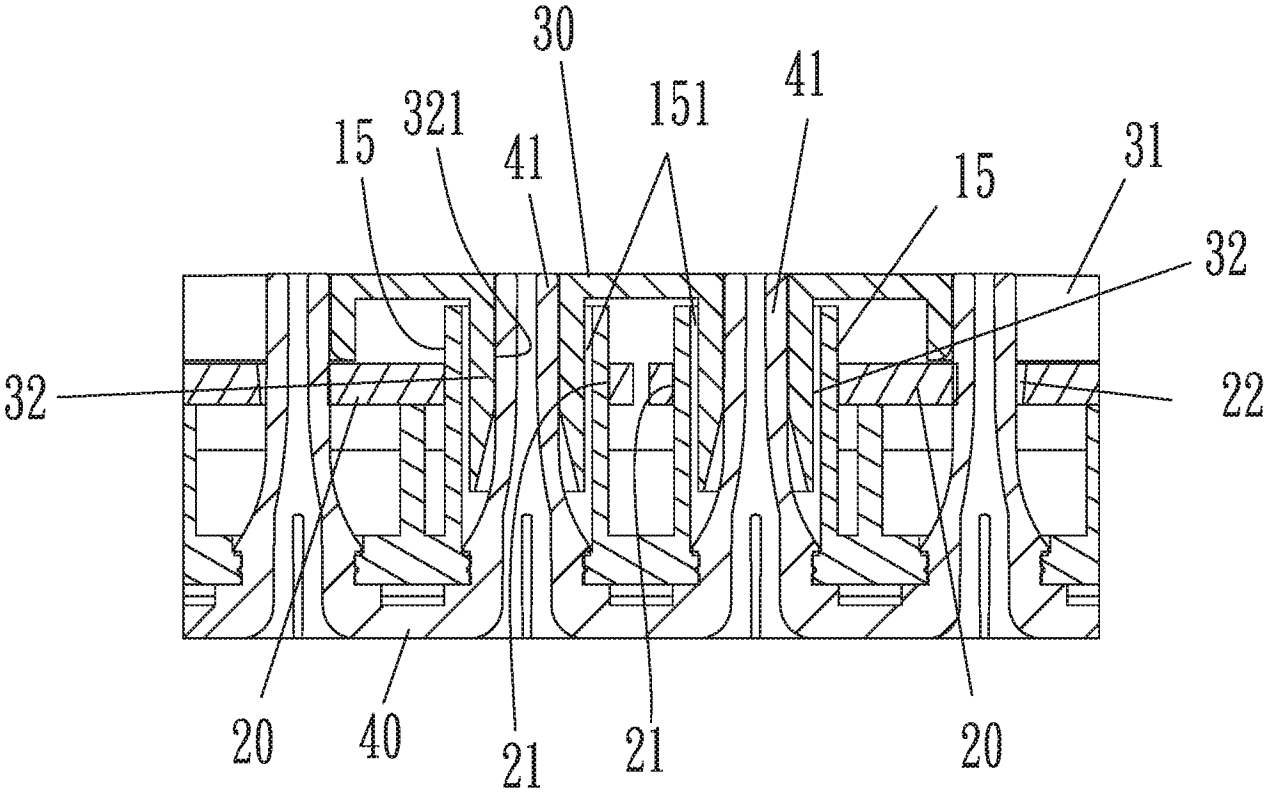
FIG. 19 is a partial front cross sectional view of the embodiment in FIG. 18.

Referring to FIG. 18 and FIG. 19 of the drawings, a nozzle adjustment member for a sprinkler according to a third embodiment is illustrated, wherein the nozzle adjustment member for a sprinkler comprises a hollow pipe 10, two adjustment pieces 20, a nozzle cover 30 and two nozzle sets 40.

A flat top stage 11 with a plurality of holes 14 spaced at an interval along an axis of the hollow pipe 10 is disposed on the top of the hollow pipe 10. The holes 14 are assembled with a plurality of nozzle tubes 41 of a nozzle set 40 mounted in the hollow pipe 10. A pivot support 15 is extending around each of two holes 14 on the middle part of the hollow pipe 10. The hole 14 inside the pivot support 15 is positioned over the corresponding nozzle tubes 41 of the nozzle set 40 for location while a tube hole 151 of the pivot support 15 is for receiving and locating shaft tubes 32 of a nozzle cover 30. Each of the pivot support 15 is received in a pivot hole 21 at one end of the adjustment piece 20.

The two adjustment pieces 20 have similar structure to that of the above embodiments. The pivot hole 21 positioned over the pivot support 15 is arranged at one end of the adjustment piece 20 and a plurality of guiding openings 22 extending outwardly from the pivot hole 21 is disposed on the adjustment piece 20. The plurality of guiding openings 22 are assembled with the plurality of nozzle tubes 41 correspondingly.

The nozzle cover 30 also has similar structure. Two shaft tubes 32 extending downwardly and mounted in the tube holes 151 of the pivot support 15 are disposed on a middle part of the nozzle cover 30. A plurality of long through holes 31 for being positioned over the corresponding nozzle tubes 41 is arranged on the nozzle cover 30, extending outwardly from the two shaft tubes 32.

Thereby the two nozzle tubes 41 on the middle of the nozzle set 40, the pivot holes 21 of the two adjustment pieces 20 and the shaft tubes 32 of a nozzle cover 30 are all assembled with two pivot supports 15 of the hollow pipe 10 and are fixed. Thus while the adjustment piece 20 swings, the pivot hole 21 is used as a pivot, the nozzle tubes 41 move an angle along with the movement of the adjustment piece 20 except the nozzle tubes 41 in the holes 14 inside the pivot support 15 that are fixed and stopped.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A nozzle adjustment member for a sprinkler, comprising:

a hollow pipe disposed with at least one row of a plurality of nozzle tubes;

a nozzle cover fastened and integrated with said hollow pipe and having at least one row of long through holes positioned over said plurality of nozzle tubes and arranged on a top thereof;

a shaft tube disposed on a middle part of said nozzle cover; and a single piece having one row of a plurality of long through holes positioned over said plurality of nozzle tubes and assembled between said hollow pipe and said nozzle cover, wherein said single piece has a pivot hole disposed on a middle part thereof and a set of control parts disposed on two ends thereof, wherein said pivot hole is positioned over said shaft tube as a pivot such that said control part is operated to drive two ends of said single piece to swing in a pendulum-type path and said plurality of nozzle tubes is adjusted at different angles respectively, thereby providing different water distribution patterns at different angles on two sides, wherein said single piece comprises two adjustment pieces, wherein each of said adjustment pieces has a pivot hole and said pivot holes of said adjustment pieces are overlapped and integrated to define said pivot hole of said single piece, so as to enable said single piece to swing at reverse direction through said pivot.

2. The nozzle adjustment member for a sprinkler, as recited in claim 1, wherein said through holes of said single piece are respectively arranged in said adjustment pieces, wherein said through holes arranged in different adjustment pieces are equal in height.

3. The nozzle adjustment member for a sprinkler, as recited in claim 1, wherein said hollow pipe is disposed with a plurality of holes that are aligned and spaced at an interval and said plurality of nozzle tubes project from said plurality of holes to an outside of said hollow pipe correspondingly, wherein said hollow pipe is arranged with a plurality of racks equal in height for supporting said adjustment pieces stably.

4. The nozzle adjustment member for a sprinkler, as recited in claim 1, wherein said set of control parts comprises two control parts and each of said control parts is disposed on one end of said adjustment member.

* * * * *